US012338586B2

(12) United States Patent
Sutton

(10) Patent No.: US 12,338,586 B2
(45) Date of Patent: Jun. 24, 2025

(54) METHOD AND APPARATUS FOR CREATING AN OVERLAY TO REINFORCE AND REPAIR HARD SURFACES

(71) Applicant: Cornerstone Construction Material, LLC, Lee's Summit, MO (US)

(72) Inventor: Jeff Sutton, Archie, MO (US)

(73) Assignee: Cornerstone Construction Material, LLC, Lee's Summit, MO (US)

( * ) Notice: Subject to any disclaimer, the term of this patent is extended or adjusted under 35 U.S.C. 154(b) by 480 days.

(21) Appl. No.: 17/463,249

(22) Filed: Aug. 31, 2021

(65) Prior Publication Data

US 2022/0064878 A1 Mar. 3, 2022

Related U.S. Application Data

(60) Provisional application No. 63/125,291, filed on Dec. 14, 2020, provisional application No. 63/072,767, filed on Aug. 31, 2020.

(51) Int. Cl.
*E01C 19/45* (2006.01)
*E01C 11/00* (2006.01)

(52) U.S. Cl.
CPC ..... *E01C 19/45* (2013.01); *E01C 11/005* (2013.01)

(58) Field of Classification Search
CPC ..... E01C 11/005; E01C 19/45
USPC ..... 404/75, 111
See application file for complete search history.

(56) References Cited

U.S. PATENT DOCUMENTS 805,719 A * 11/1905 Fitzgerald, Jr. ..... E01C 23/0973 404/101
1,062,029 A * 5/1913 Pillsbury ..... B08B 3/026 239/131
2,718,335 A 9/1955 Shippen
2,877,476 A * 3/1959 Kraszewski ..... A47L 13/30 401/48
3,245,329 A 4/1966 Leon et al.
3,771,893 A 11/1973 Miller
4,165,192 A * 8/1979 Mellen ..... E04D 15/07 401/137
4,286,737 A 9/1981 Gallant
4,421,797 A * 12/1983 Koehne ..... C04B 28/04 427/403
5,333,969 A 8/1994 Blaha et al.
5,700,345 A 12/1997 Payne
(Continued)

OTHER PUBLICATIONS

FABCO-AIR: "Pancake II Air Cylinders," Catalog PAN2-2.
(Continued)

*Primary Examiner* — Raymond W Addie
(74) *Attorney, Agent, or Firm* — AVEK IP, LLC; Mark C. Young

(57) ABSTRACT

A method and apparatus for distributing a liquid substance to a surface for purposes of creating an overlay to a repair or reinforce and enhance the physical properties of the surface. The invention may include a system having a pair of holding tanks for holding a resin and a hardener, a pair of fluid pumps, a manifold, a mixing chamber and an aggregate hopper. An overlay substance may be formed by the system by mixing the resin and hardener, and the substance may be dispensed through a linear distribution apparatus onto a surface in need of repair or improvement.

5 Claims, 16 Drawing Sheets

(56) References Cited

U.S. PATENT DOCUMENTS

| | | | | |
|---|---|---|---|---|
| 6,102,615 | A * | 8/2000 | Wilson, Sr. | E01C 19/16 118/108 |
| 6,290,428 | B1 * | 9/2001 | Hall | E01C 23/096 15/103.5 |
| 7,845,879 | B2 | 12/2010 | Maier | |
| 8,439,599 | B2 * | 5/2013 | Schmidt | E01C 23/0973 118/108 |
| 9,109,332 | B1 | 8/2015 | Stone, Jr. | |
| 2005/0019187 | A1 * | 1/2005 | Whitworth | F04B 23/06 417/532 |
| 2007/0012700 | A1 | 1/2007 | Catteau | |
| 2015/0240430 | A1 | 8/2015 | Holding | |

OTHER PUBLICATIONS

Stamixco: GX Static Mixer Product Bulletin for High Performance Mixing & Dispersion of Viscous Fluids, GX-3.4 (Feb. 14, 2012).
Ampco Pumps Company: ZP Series Positive Displacement Pumps, Rev3.18.

* cited by examiner

METHOD AND APPARATUS FOR CREATING AN OVERLAY TO REINFORCE AND REPAIR HARD SURFACES

CROSS REFERENCE TO RELATED APPLICATIONS

This application claims the benefit of provisional application Ser. No. 63/072,767, filed Aug. 31, 2020, entitled METHOD AND APPARATUS FOR CREATING AN OVERLAY TO REINFORCE AND REPAIR HARD SURFACES, and provisional application Ser. No. 63/125,291, filed Dec. 14, 2020, entitled METHOD AND APPARATUS FOR DISTRIBUTING A LIQUID SUBSTANCE TO CREATE AN OVERLAY.

FIELD

The present invention relates to a method and apparatus for distributing a liquid substance to a surface for purposes of creating an overlay to a repair, reinforce, and/or enhance the physical properties of the surface. Specifically, the invention comprises a method and apparatus that distributes a liquid that, when cured, creates a polymer-based overlay that can be applied to new or worn roadways, sidewalks, parking lots, bridges and the like to improve their quality, friction and durability.

BACKGROUND

Various technologies exist for repairing roadways, sidewalks, parking lots, bridges and the like. Such areas, where vehicle and foot traffic are common, are typically constructed from asphalt or concrete. Both materials are relatively robust but will eventually become worn and in need of repair. When these materials are worn, they can develop cracks or holes that make them unsafe to travel on.

There are numerous methods for repairing areas constructed from asphalt or concrete. For minor damage, the asphalt or concrete can be patched. Patching technology ranges from simply filling cracks with sealant to excavating and resurfacing the problem area. For major damage, such as structural damage to a bridge, large sinkholes, or catastrophic damage done by natural disasters, the affected structure usually must be completely rebuilt.

Repairing damaged roadways is expensive and often requires heavy machinery and a team of workers. It requires the roadway to be shut down or narrowed for a length of time, which impacts traffic and safety. In particular, the longer a roadway is under construction, the longer the repair workers for the road are at risk of injury due to passing vehicles.

A primary drawback for current surface repair technologies is that heavy machinery is typically required, which ultimately necessitates numerous workers to operate the heavy machinery. Heavy machinery and the associated workers result in a relatively high cost of repair. Also, due to the numerous workers that are required, there are obvious safety concerns for having workers in close proximity to traffic. Finally, the longevity of certain repair methods is minimal, leading to repairs being necessary more often.

The present invention addresses these problems by providing a durable and more efficient repair method, that does not require as many workers or the extended repair times of conventional methods. The invention can also be used to increase the longevity of newly constructed surfaces, thus minimizing the number of repairs necessary.

SUMMARY

The present invention relates to a method and apparatus for distributing a liquid substance to a surface for purposes of creating an overlay to a repair or reinforce and enhance the physical properties of the surface. Specifically, the invention comprises a method and apparatus that produces and distributes a liquid that, when cured, creates a polymer-based overlay that can be applied to new or worn roadways, sidewalks, parking lots, bridges and the like to improve their quality and durability.

In one embodiment, the invention comprises a system for creating an overlay to reinforce or repair a surface, which includes a pair of holding tanks, a pair of fluid pumps, a manifold, a mixing chamber and an aggregate hopper. The polymer is separated into a resin and hardener when stored in the holding tanks. A first holding tank contains a resin and a second holding tank contains a hardener. The resin and hardener are generally stable and unchanging when kept separate, but reactive when mixed. The first holding tank is in fluid communication with a first pump and the second holding tank is in fluid communication with a second pump. The pumps move the resin and hardener to a manifold to start the mixing process. The first pump is in fluid communication with a first inlet on the manifold and the second pump is in fluid communication with a second inlet on the manifold. The channels connected to the inlets may combine to direct the fluids to an outlet on the manifold.

An overlay binder is formed by mixing the resin and hardener, at which point the substances react to begin the polymer curing process. Mixing may occur in a mixing chamber that is in fluid communication with the manifold. The mixing chamber is adapted to combine the reside and hardener into a mixed substance. The mixed substance may ultimately be dispensed from a distribution apparatus onto a surface to be reinforced or repaired. The distribution apparatus may include a longitudinal body or shell with an opening, and the mixed substance can be delivered into the shell and then dispensed through the opening onto the surface. The distribution apparatus may have a plug that is shaped and sized to block or plug the opening to stop the flow of the mixed substance. Aggregate may be added to the polymer mixture or a surface treatment may be applied as desired.

The system may be mounted to a motor vehicle such as a truck or to a trailer so that the material can be transported to the location where an overlay is needed. The truck or trailer may be fitted with the distribution apparatus, which allows the overlay material to be applied to the surface in need of repair or improvement. In that instance, the truck or trailer transports, mixes, and distributes the overlay material without the need for additional vehicles. When cured, the polymer-based overlay is stable, durable, and adhered in place. Typically, the overlay is more resistant to deterioration (cracks, splits, holes, etc.) than the surface material it covers.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," "leftwardly," "upper," and "lower" will refer to the installed position of the item to which the reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 1:
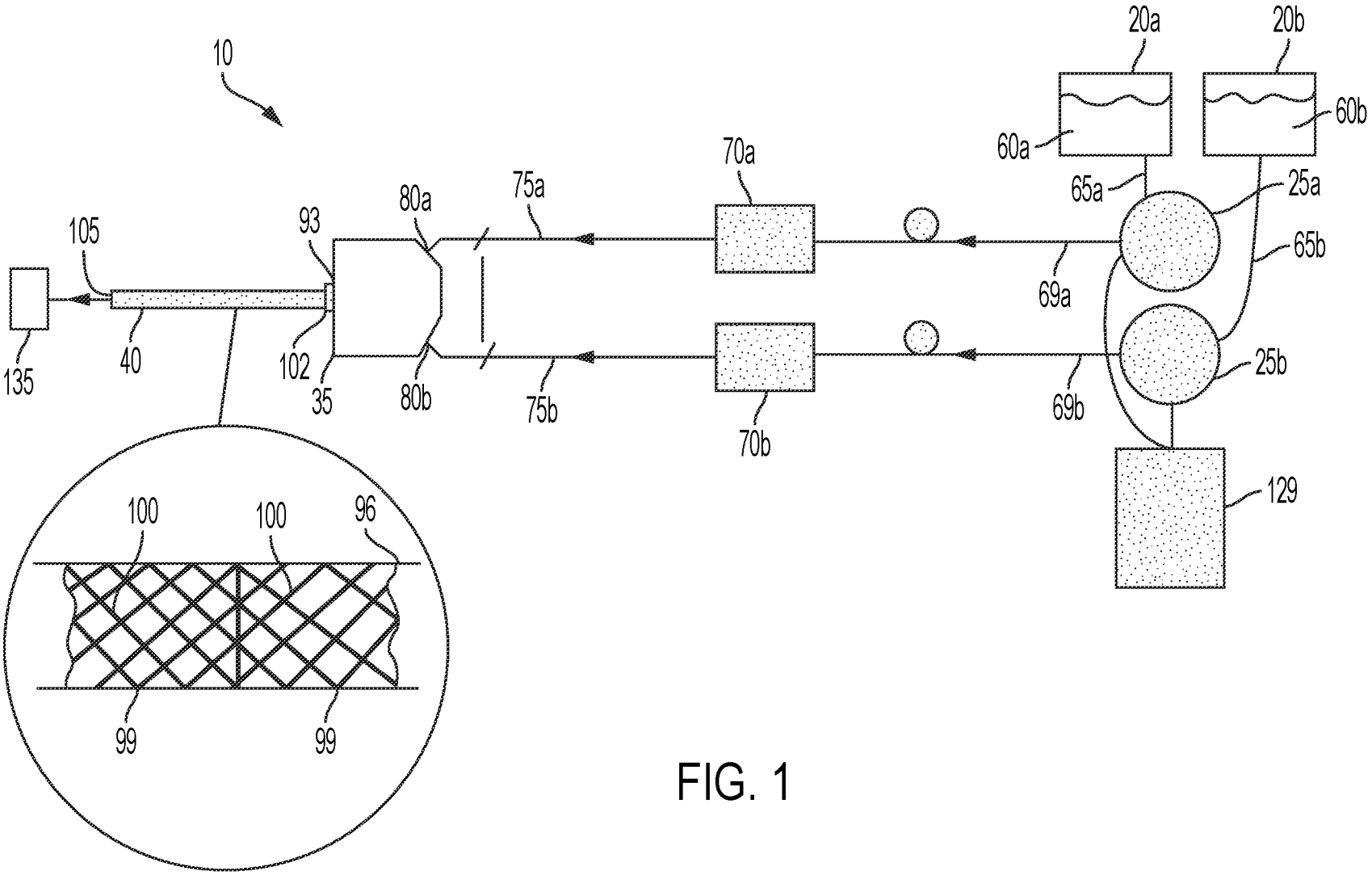
FIG. 1 is a diagrammatic layout of a mixing system that produces a liquid to create a polymer-based overlay.
Figure 2:
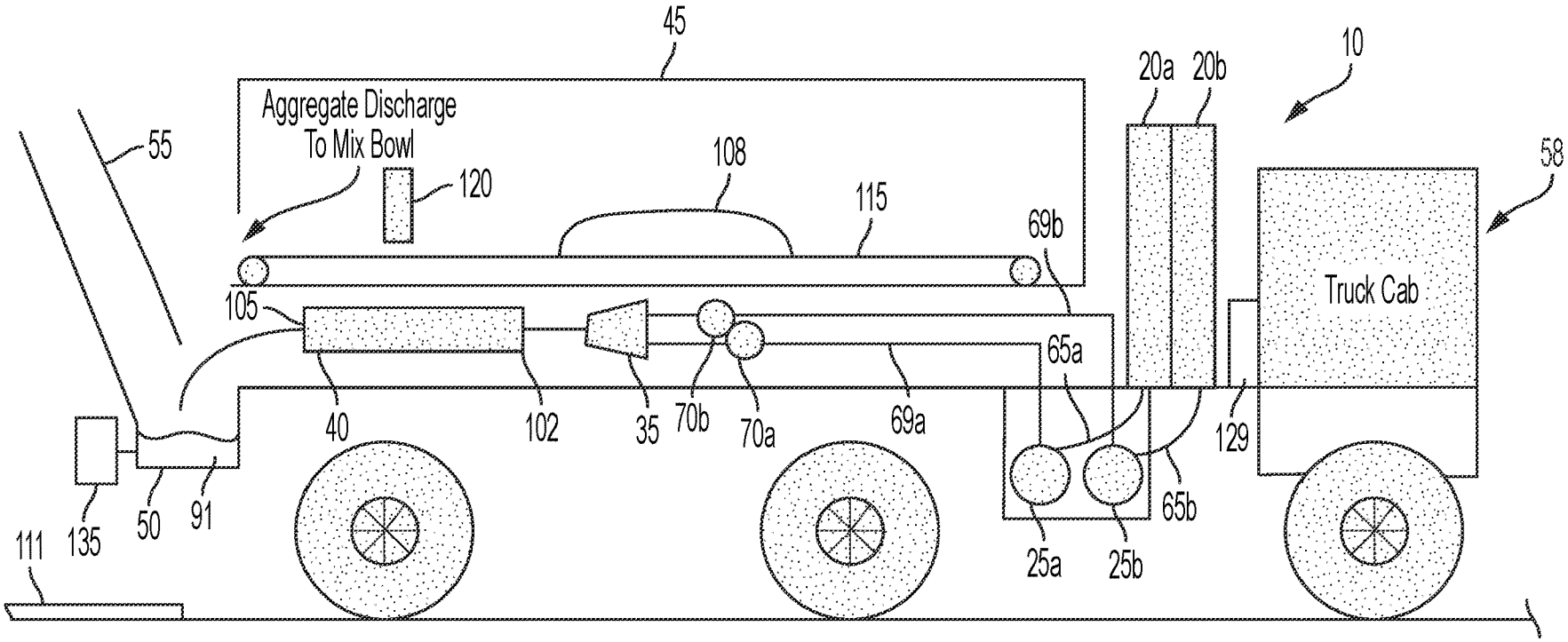
FIG. 2 is a diagrammatic layout of the mixing system of FIG. 1 mounted to a truck.

Referring to the figures, FIGS. 1 and 2 show an exemplary embodiment of the invention comprising a mixing system 10 for producing a liquid to create a polymer-based overlay, which includes a first holding tank 20*a* and a second holding tank 20*b*, a first pump 25*a* and a second pump 25*b*, a manifold 35, a mixing chamber 40, an aggregate hopper 45, a mixing bowl 50, and a discharge chute 55. The mixing system 10 may optionally be mounted to a vehicle such as a truck 58 or a trailer (not shown).

As shown in FIGS. 1 and 2, mixing system 10 includes two tanks or compartments for holding two different portions of the polymer. Holding tank 20*a* may hold a resin 60*a* and holding tank 20*b* may hold a hardener 60*b*. Each substance is in a liquid or slurry form and may kept in a temperature range appropriate to ensure a stable shelf life of the respective resin 60*a* and hardener 60*b*. The exact temperature will depend on the type of resin 60*a* and hardener 60*b*. The holding tanks 20*a* and 20*b* are typically the same size, particularly when the polymer is formed by mixing resin 60*a* and hardener 60*b* at a 1:1 ratio. It is foreseen that the tanks can also be different sizes, for example if necessitated by a mixing ratio that requires more of one substance (resin or hardener) versus the other substance. It is also foreseen that, even if the holding tanks 20*a* and 20*b* are the same size, different amounts of the resin 60*a* and hardener 60*b* can be stored therein. Although the size of holding tanks 20*a* and 20*b* will depend on the amount of mixed substance needed, in one embodiment, tank sizes of 250-gallons was sufficient.

Connected to an outlet of each holding tank 20*a* and 20*b* is a pipe 65, which may also be a hose or tube. Pipe 65*a* may be connected to the outlet of tank 20*a* and pipe 65*b* may be connected to the outlet of tank 20*b*. There may be shutoff or isolation valve at the outlet of each holding tank or placed between each holding tank 20 and its respective pipe 65. The diameter of each pipe 65 will depend on the application, however in one embodiment pipes having 1½ inch diameters were sufficient.

Pipe 65*a* may be connected to the inlet of first pump 25*a* and a pipe 65*b* may be connected to the inlet of second pump 25*b*. Pumps 25*a* and 25*b* may be gravity fed from holding tanks 20*a* and 20*b*. It is foreseen that various types of pumps may be used as long as they are sufficiently sized based on pressure and flow as required for mixing system 10. In one embodiment, pumps 25*a* and 25*b* may be positive displacement pumps rated at 36 gallons per minute with a maximum differential pressure of 200 pounds per square inch. The flow and pressure requirements for pumps 25*a* and 25*b* will be dependent on the viscosity of resin 60*a* and hardener 60*b*, as well as the sizes and pressure drops associated with other equipment and piping in system 10.

Connected to the outlet of each pump 25*a* and 25*b* is a pipe 69, which may also be a hose or tube. Pipe 69*a* may be connected to the outlet of pump 25*a* and pipe 69*b* may be connected to the outlet of tank 25*b*. The diameter of each pipe 65 will depend on the application, however in one embodiment pipes having 1½ inch diameters were sufficient. Pipe 69*a* may be connected to a flow meter 70*a* and pipe 69*b* may be connected to a flow meter 70*b*. The size of the flow meters 70 will also depend on the application, however in one embodiment, a flow meter with a maximum flow rate of 66 gallons per minute was sufficient. Connected to an outlet of each flow meter 70*a* and 70*b* is a pipe 75, which may also be a hose or tube. Pipe 75*a* may be connected to the outlet of flow meter 70*a* and pipe 75*b* may be connected to the outlet of flow meter 70*b*. The diameter of each pipe 75 will depend on the application, however in one embodiment 1½ inch diameter pipes were sufficient. Each pipe 75 may then be connected to manifold 35.

Figure 3:
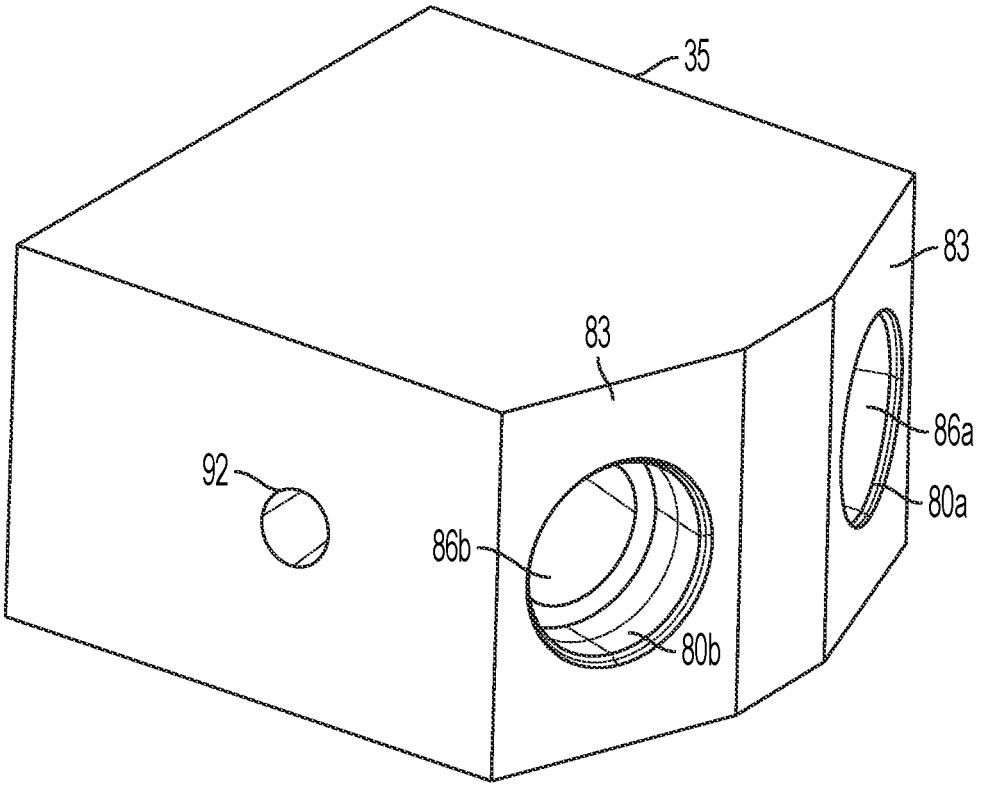
FIG. 3 is a front perspective view of a manifold.
Figure 4:
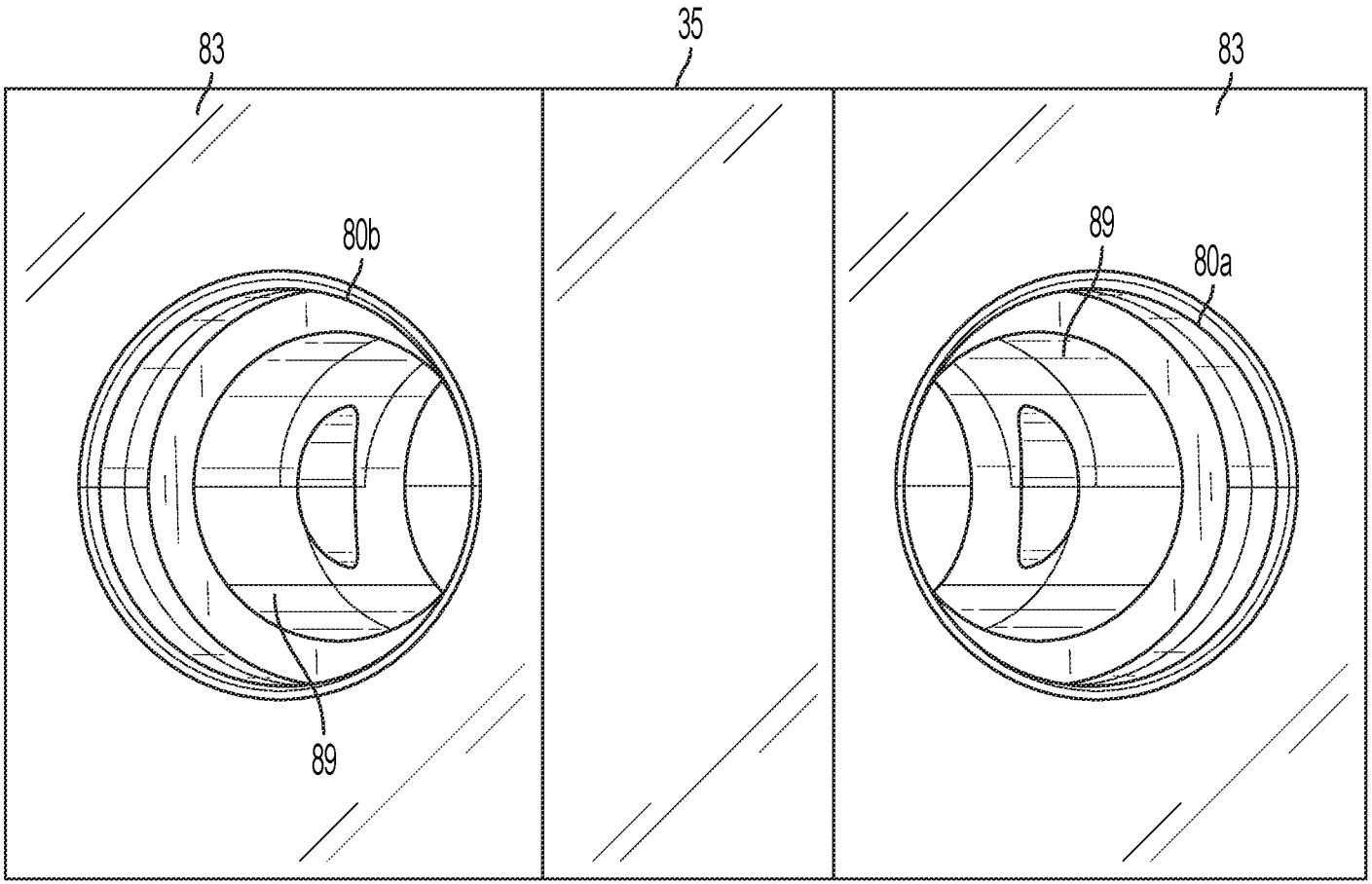
FIG. 4 is a front view of the manifold of FIG. 3.
Figure 5:
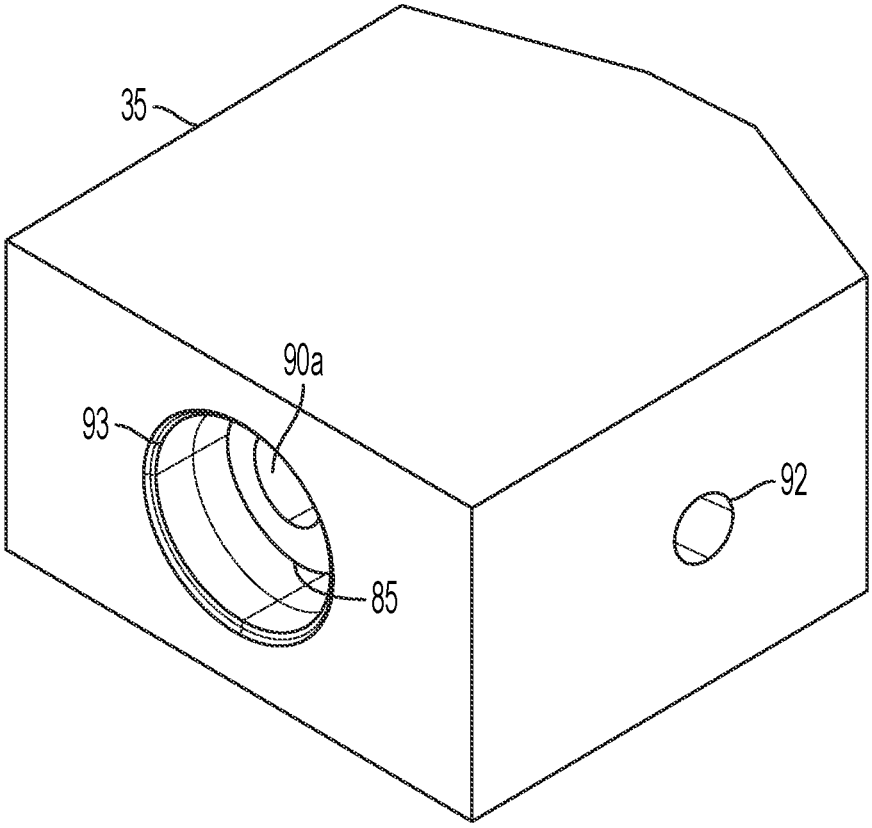
FIG. 5 is a back perspective view of the manifold of FIG. 3.
Figure 6:
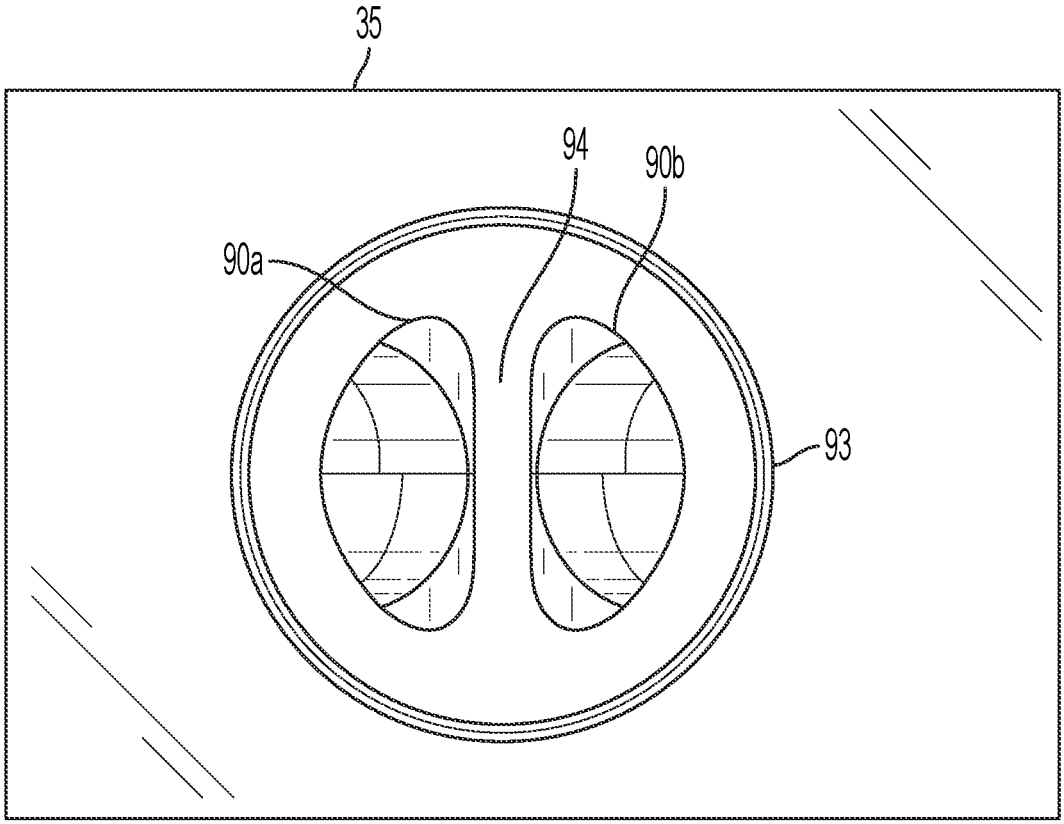
FIG. 6 is a back view of the manifold of FIG. 3.
Figure 7:
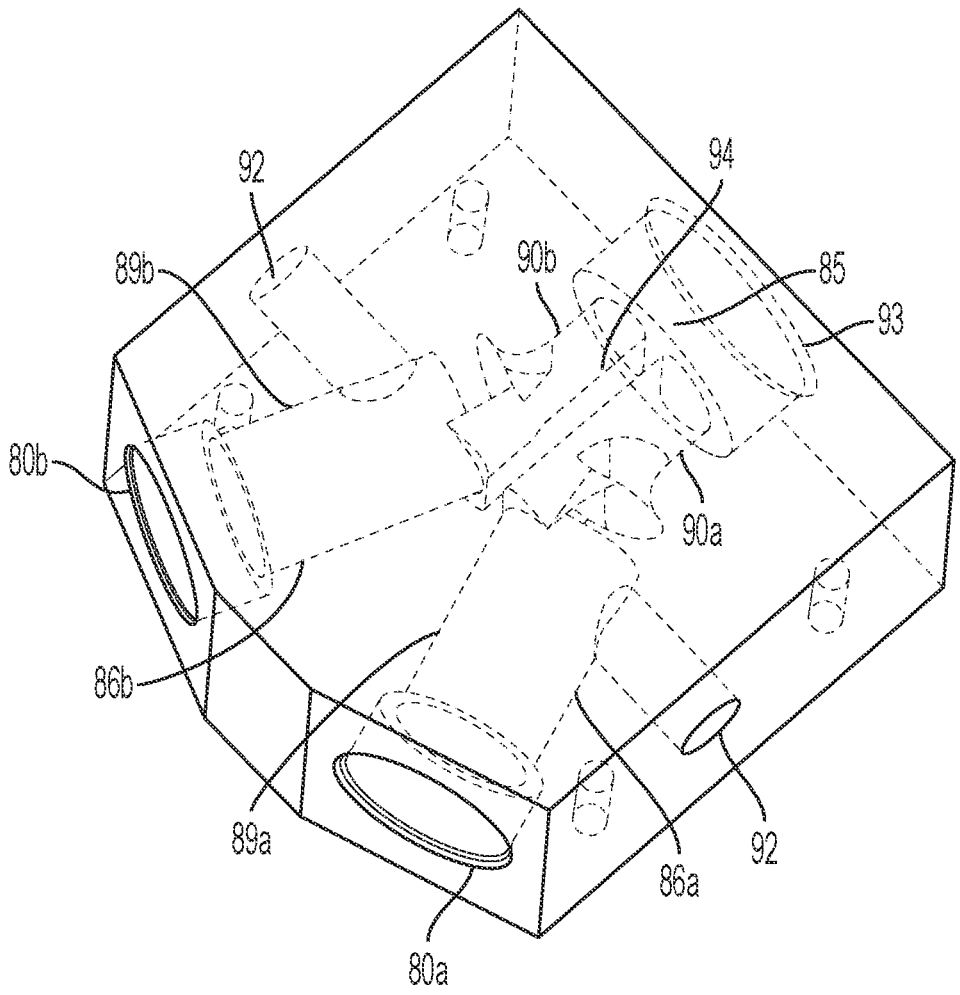
FIG. 7 is a perspective view of the manifold of FIG. 3 with internal passages in the manifold shown in broken lines.

As best seen in FIGS. 3 and 4, manifold 35 may have two inlets 80 to which pipes 75 connect. Pipe 75*a* is connected to inlet 80*a* and pipe 75*b* is connected to inlet 80*b*. Inlets 80 may be formed on opposing angled surfaces 83 on the front of the manifold 35, which allow the inlets 80 to be slightly angled toward a confluence area 85 proximate outlet 93 of manifold 35. As shown in FIG. 7, inlets 80 communicate with internal passageways or channels 86 to direct the material pumped into the manifold 35, namely resin 60*a* and hardener 60*b*, toward the confluence area 85 where the two types of material combine. Inlet 80*a* is in fluid communication with channel 86*a* and inlet 80*b* is in fluid communication with channel 86*b*. Channels 86 may include first segments 89 near their inlets 80, wherein the first segments 89 have generally circular cross sections. Channels 86 may include second segments 90 adjacent to and in fluid communication with the first segments 89, wherein the second segments 90 have generally semicircular cross sections. FIG. 4 shows the circular first segments 89 and FIG. 6 shows the semicircular second segments 90. FIG. 7 shows the first segments 89 of channels 86 transitioning to second segments 90. More specifically, channel 86*a* includes a circular first segment 89*a*, which transitions to a semicircular second segment 90*a*. Channel 86*b* includes a circular first segment 89*b*, which transitions to a semicircular second segment 90*b*. Channels 86 may include sampling ports 92 to allow sampling of the material flowing through the channels.

As shown in FIGS. 6 and 7, the second segments 90 of channels 86 may intersect and terminate at confluence area 85, which is adjacent outlet 93 of manifold 35. The second segments 90*a* and 90*b* may be separated by a central partition 94. The central partition 94 ends at confluence area 85 thereby allowing resin 60*a* and hardener 60*b* to discharge from their respective channels 86, at which point the two materials combine into a mixture 91 in confluence area 85. As further seen in FIG. 7, manifold 35 may comprises an outlet 93 after confluence area 85. Resin 60*a* and hardener 60*b* combine to form mixture 91 in the confluence area 85 and then the mixture exits the manifold 35 through outlet 93.

Figure 8:
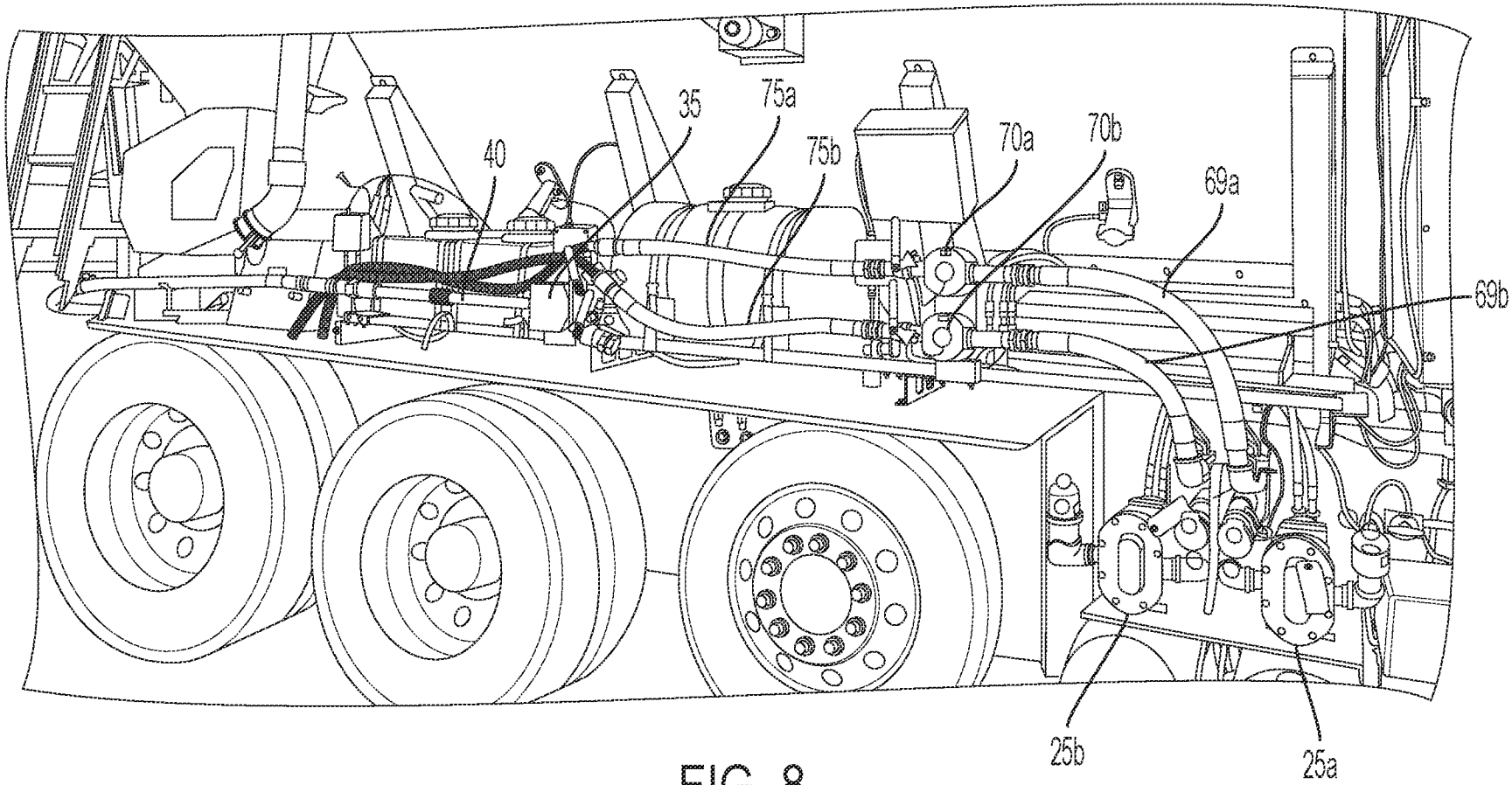
FIG. 8 is perspective view of a mixing system mounted to a truck.
Figure 9:
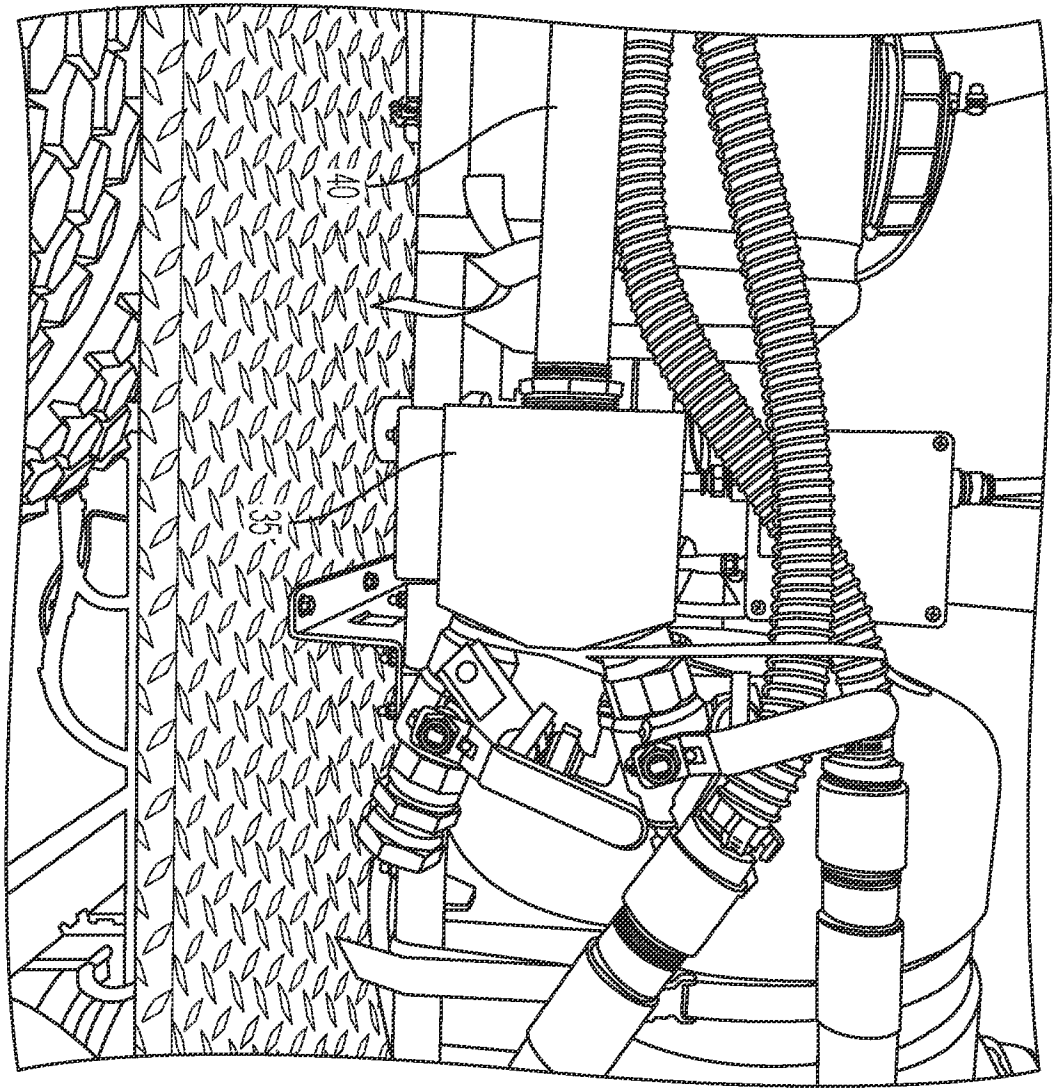
FIG. 9 is a perspective view of a manifold mounted to a truck.
Figure 10:
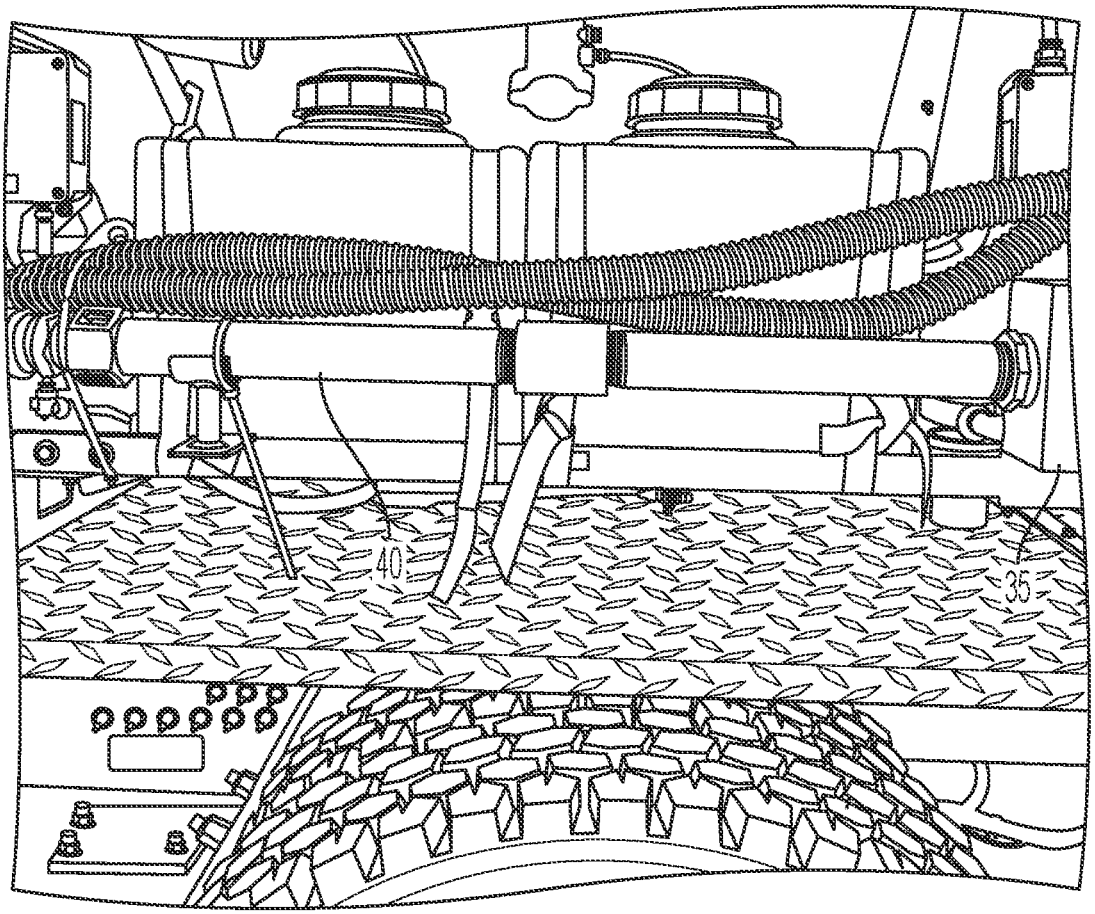
FIG. 10 is a perspective view of a mixing chamber mounted to a truck.

Turning to FIGS. 8 through 10, mixing chamber 40 (which may also be referred to as simply a mixer) may be in fluid communication with outlet 93 of manifold 35 and could be connected either directly or indirectly using a flow connector (e.g., pipe) to outlet 93. Mixing chamber 40 may comprise a cylindrical sleeve 96, which houses one or more mixing elements 99. In one embodiment, mixing chamber 40 may take the form of a static mixer, however other types of mixers are foreseen such as a chamber having movable blades or paddles. As shown in FIG. 1, each mixing element 99 may have a series of vanes or baffles 100 interconnected and fused together to redirect and blend the components in mixture 91. The baffles 100 are typically fixed with respect to one another and sleeve 96. As the mixture 91 moves through the mixing chamber 40, it passes through the mixing elements 99 and is blended due to the constant redirection of the portions of the mixture 91 that encounter a baffle 100. Baffles 100 may be plastic, metal, or another durable material. Mixing occurs when mixture 91 is pumped through sleeve 96 such that mixture 91 passes through a mixing element 99. Mixture 91 may be in a generally unmixed state at the first end 102 of mixing chamber 40 and is in a generally mixed state at the second end 105 of mixing chamber 40. The resin 60*a* and hardener 60*b* begin reacting when they meet in the confluence area 85 of manifold 35 and the reaction is enhanced once mixture 91 is in a mixed state at the end of mixing chamber 40. The diameter of mixing chamber 40 will depend on the application, however in one embodiment a 1½ inch diameter mixing chamber was sufficient.

As shown in FIG. 2, mixing system 10 may include an aggregate hopper 45. Hopper 45 may contain an aggregate 108 that can be combined with mixture 91 to form a polymer substance that, once dried, is a durable overlay 111 that may be used to repair or reinforce a hard surface. Aggregate 108 may include any number of granular materials, such as sand or stone, which help add volume, durability, and enhanced physical properties to overlay 111. Hopper 45 may be any container that is able to hold the desired amount of aggregate. In one embodiment, hopper 45 takes the form of container mounted to the bed of a truck. Aggregate 108 may be dispensed from hopper 45 any number of ways including a conveyor system 115. Other options include a controlled pour, an auger, or even manual dispensing via shovels and the like. Hopper 45 may also include a door or gate 120 that allows discharge of the aggregate 108 when open and retains the aggregate 108 when closed.

Mixing system 10 may also include a mix bowl 50, which receives aggregate 108 that is discharged from hopper 45 as well as mixture 91 that is discharged from mixing chamber 40. The mix bowl 50 may include an agitator (not shown) that assists with blending the aggregate 108 with the mixture 91 in the mix bowl 50. The blended combination of aggregate 108 and mixture 91 may then be applied to the desired surface and allowed to cure to form overlay 111. The application can be done manually (e.g., by pouring or shoveling the blended combination of aggregate 108 and mixture 91) or via an automated tool such as a discharge chute 55 or other delivery mechanism.

Mixing system 10 may also include various shut-off or isolation valves at all or any connection points in the system as desired. Such valves can be ball valves or any other type of valve commonly used for shut-off or isolation purposes. Mixing system 10 may also include pressure gauges at various points throughout the system to assist with monitoring pressures at various points in the system.

Mixing system 10 may also include a control system 129 (FIG. 1) to automate operation, data logging and reporting for various components. For example, the control system 129 may control one or more of the first pump 25*a*, second pump 25*b*, conveyor system 115, gate 120, and any of the various valves in the system. Control system 129 may receive input from flow meters 70, or any pressure gauges or sensors that might be in the system. A purpose of the control system 129 is to automate the mixing and dispensing of the mixture to ensure proper curing.

In one embodiment, control system 129 includes logic and control circuitry and a master controller which provides commands to the logic and control circuitry to operate various components of mixing system 10. Control system 129 may include one or more processors operable to execute a series of programmed instructions and one or more memory devices operable to store programmed instructions for execution by the control system, and one or more memory devices operable to store system data parameters obtained by the logic and control circuitry monitoring the various sensors and gauges in the system. Communication between the master controller and the logic control circuitry may be through a communications bus or wireline, or may be via other wired or wireless means.

As shown in FIGS. 11-15, the invention may also include a distribution apparatus 135 to distribute or apply the mixture 91 to the desired surface to create overlay 111. Distribution apparatus 135 may be configured to receive mixture 91 from mixing chamber 40 and then dispense the mixture 91 through one or more openings onto the desired surface. Distribution apparatus 135 may be mounted to a motor vehicle such as truck 58 or a trailer (not shown). It is foreseen that distribution apparatus 135 may be used with the mixing system 10 described herein or any other system where a liquid substance is applied to a surface.

Figure 11:
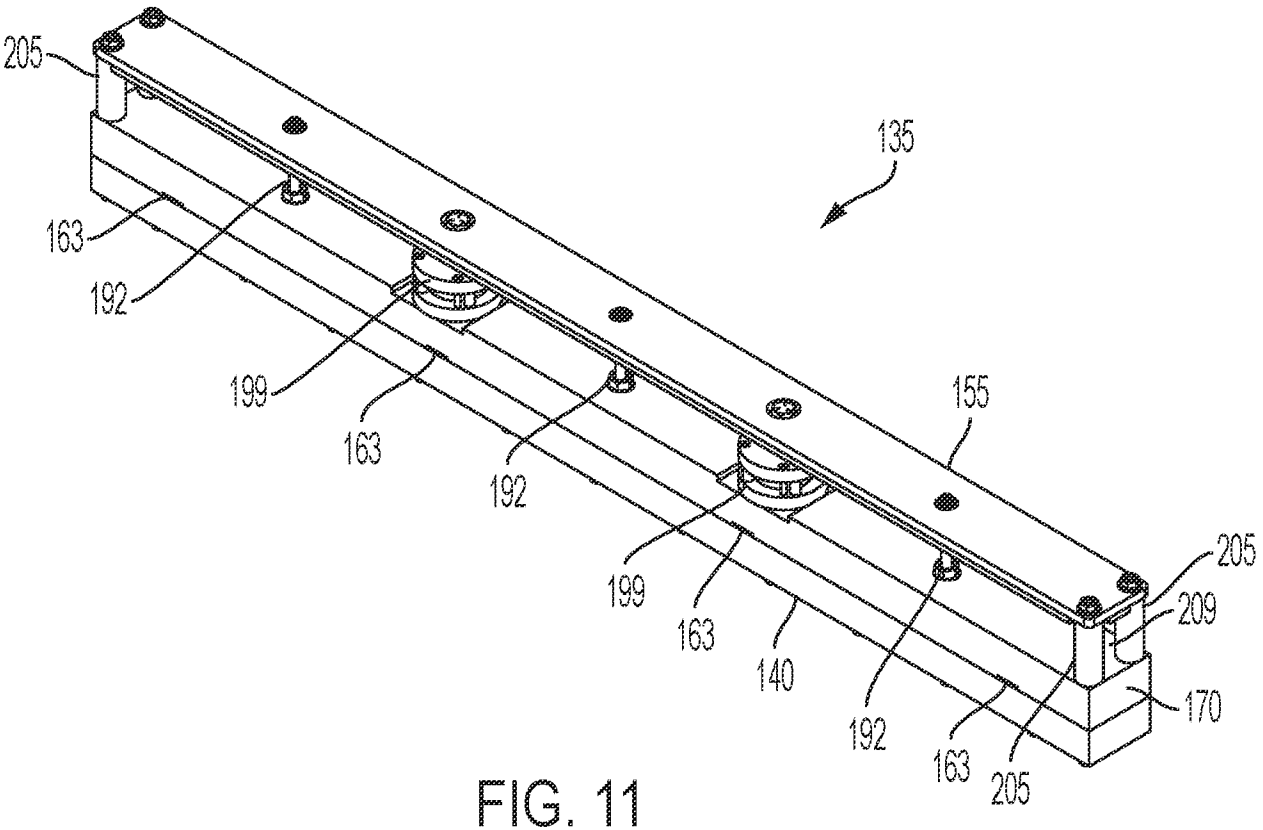
FIG. 11 is a front perspective view of a distribution apparatus.
Figure 12:
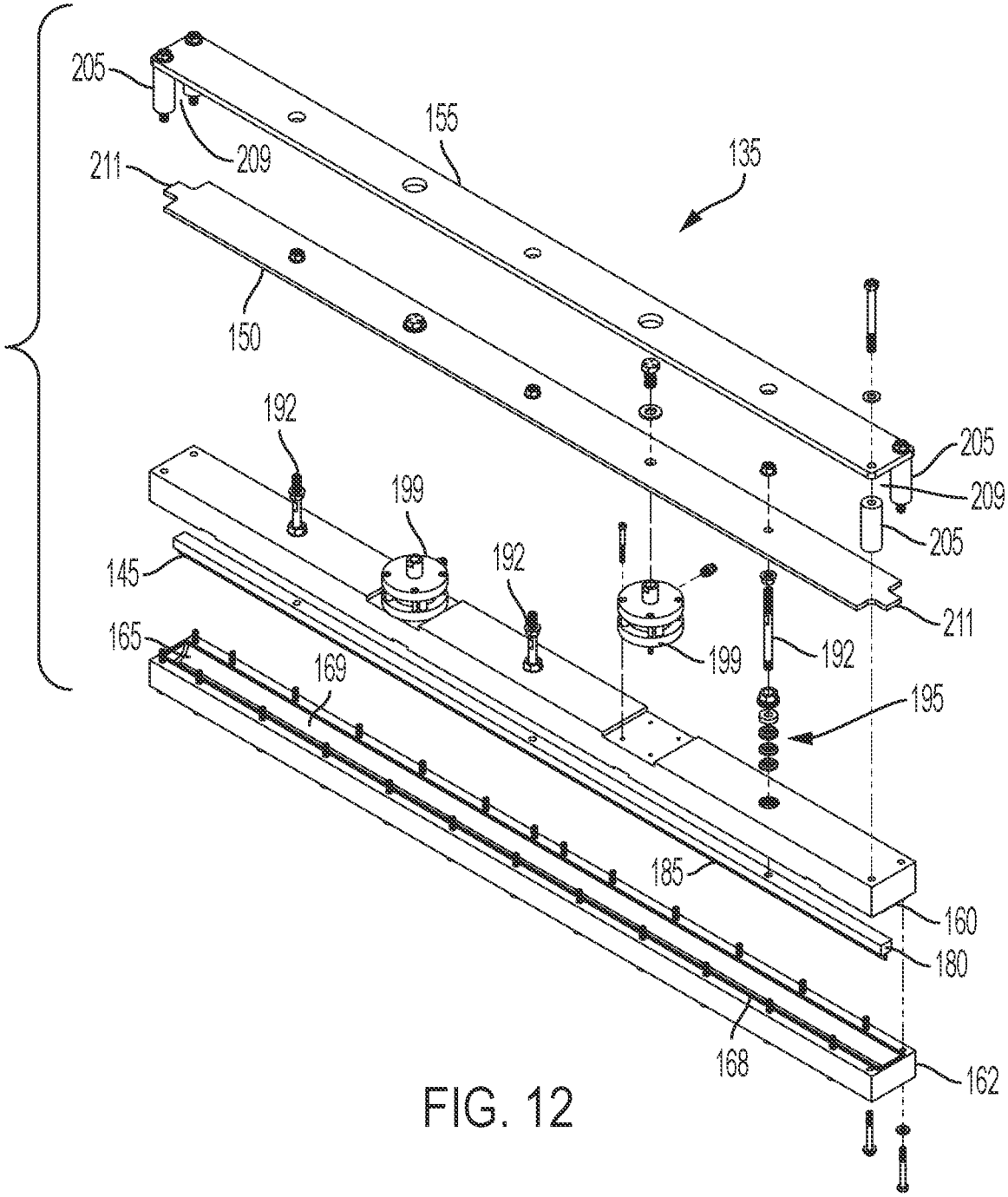
FIG. 12 is an exploded front perspective view of the distribution apparatus of FIG. 11.
Figure 13:
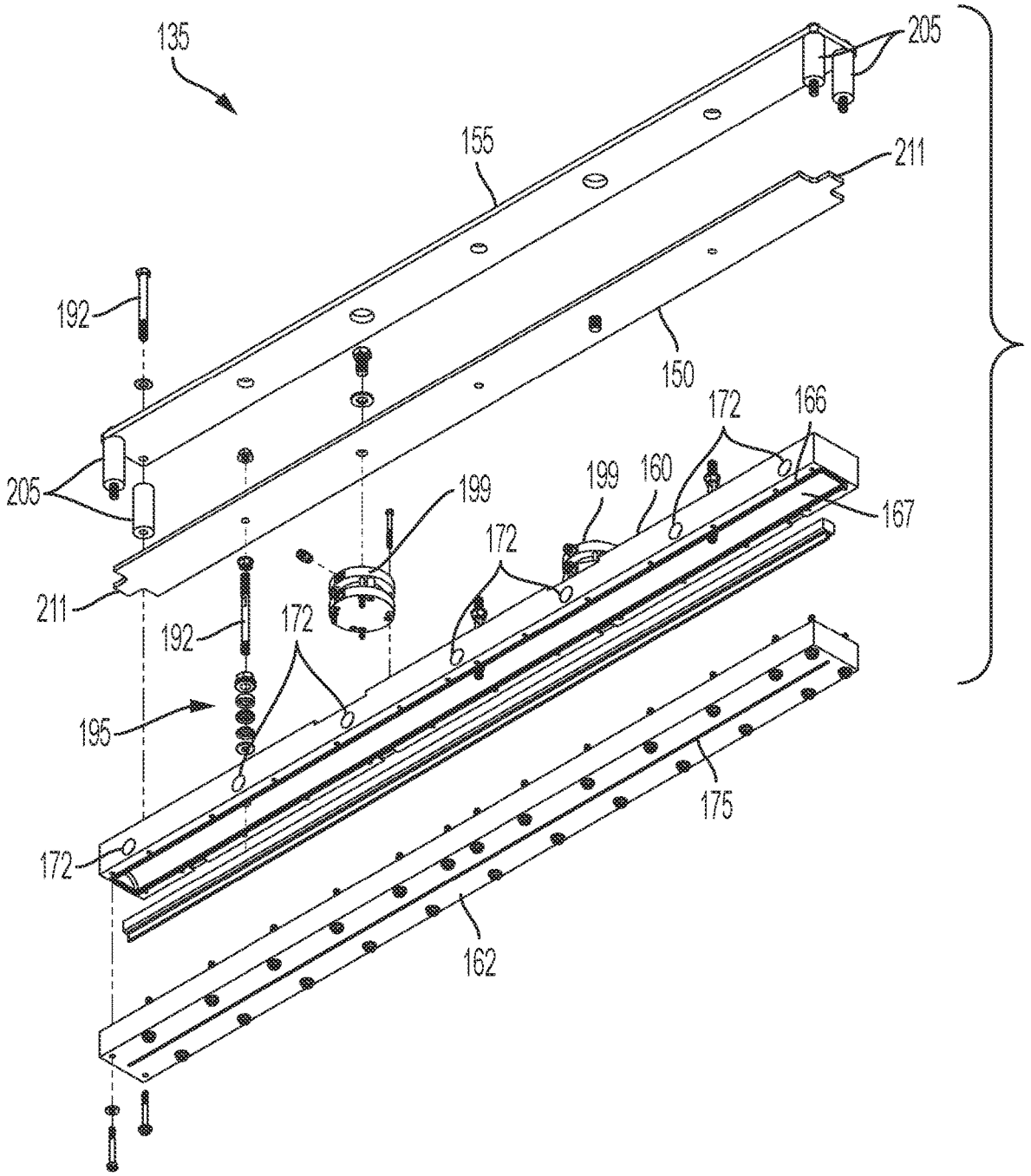
FIG. 13 is an exploded back perspective view of the distribution apparatus of FIG. 11.
Figure 15A:
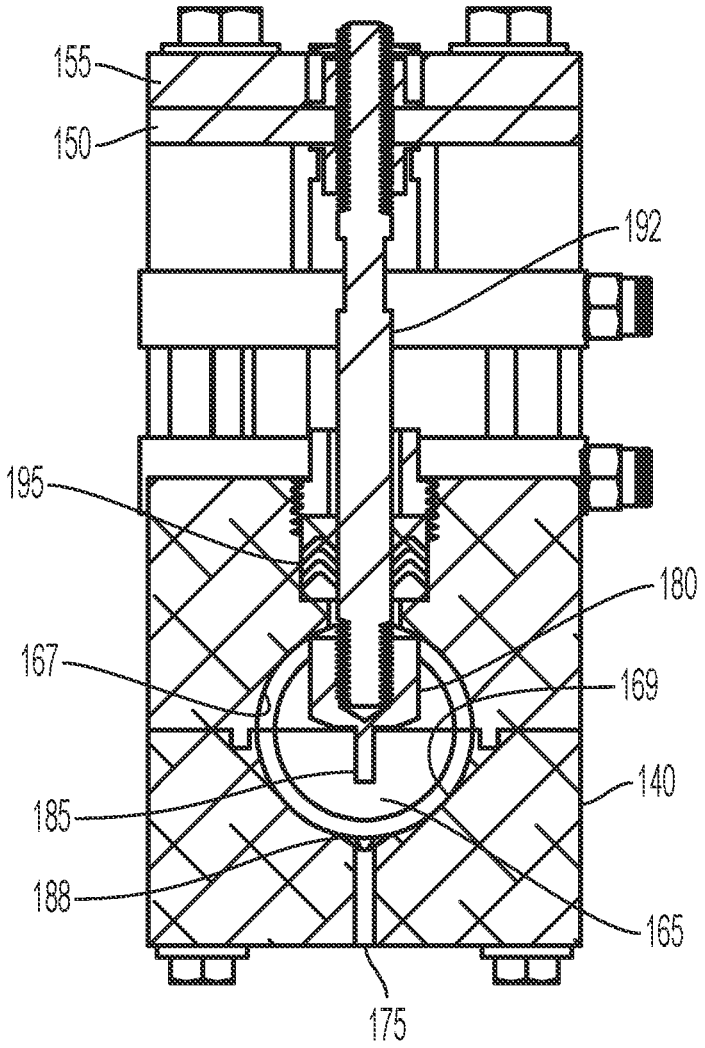
FIG. 15A is a cross-sectional view of the distribution apparatus taken along line 15A-15A in FIG. 14A showing the stopper in a raised position.
Figure 15B:
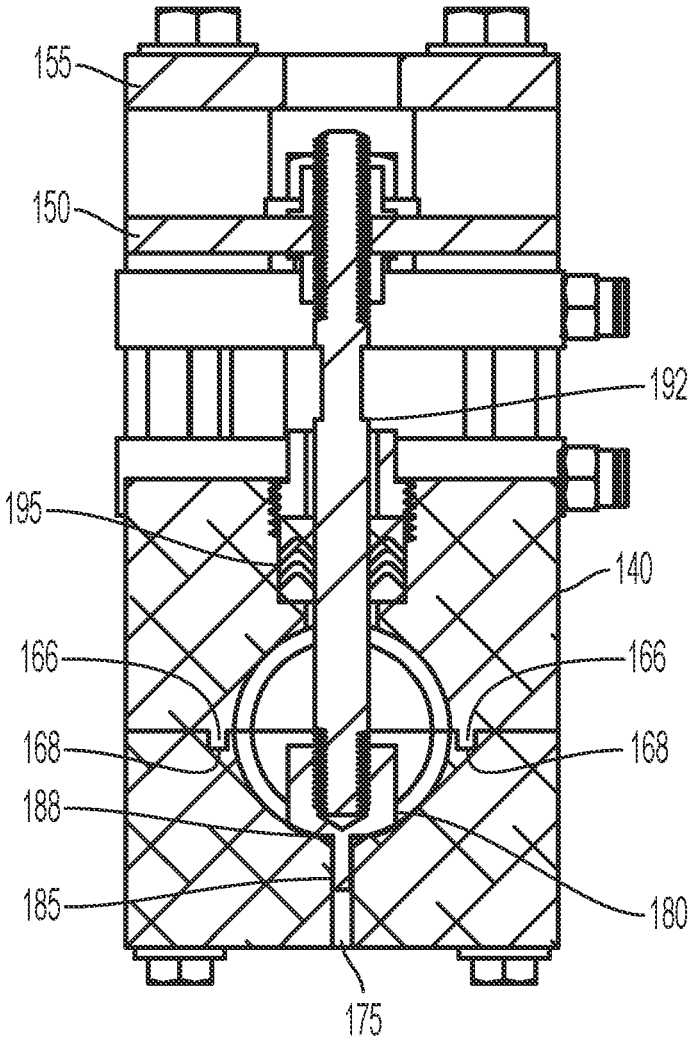
FIG. 15B is a cross-sectional view of the distribution apparatus taken along line 15B-15B in FIG. 14B showing the stopper in a lowered positioned.

As best seen in FIG. 11-13, distribution apparatus 135 comprises a body 140, an elongated stopper 145, a lifting plate 150, and an upper limit plate 155. Body 140 is a generally elongated shell having an upper portion 160 and a lower portion 162. As shown in FIGS. 15A and 15B, body 140 may have a square or rectangular transverse cross-sectional shape. The upper portion 160 mates with the lower portion 162 to create a body having a cavity 165 formed therein. To assist with alignment when joining upper portion 160 with lower portion 162, the portions may include a guide mechanism. For example, a ridge 166 may be formed on the lower perimeter of upper portion 160 and a channel 168 may formed on the upper perimeter of lower portion 162 for receiving ridge 166. Ridge 166 and channel 168 are sized and shaped such that, when the ridge 166 is received in channel 158, the upper and lower portions 160 and 162 are joined together with no leaks or gaps between the two portions. Ridge 166 and channel 168 may be continuous around the perimeter of the upper and lower portions 160 and 162 such that they encircle cavity 165, or they may be fragmented or located at one or more locations around the perimeter. It is foreseen that ridge 166 and channel 168 may have a rounded or radiused path proximate the corners of upper and lower portions 160 and 162. A radiused path may assist with preventing leaking compared to abrupt changes of direction in the path such as ninety-degree turns. Because it can be difficult to separate the upper portion 160 and a lower portion after distribution apparatus 135 is used (due to the liquid substance in cavity 165 tending to adhere the portions together), one or more separation notches 163 may be formed at the perimeter seam where the upper and lower portions meet. The separation notches 163 are slight indentations that allow partial insertion of a tool such as a flat-head screwdriver, which can then be rotated or otherwise manipulated to pry the upper and lower portions 160 and 162 apart.

Cavity 165 may be cylindrical in shape such that upper portion 160 has an upper curved wall 167 formed therein, which forms the upper portion of cavity 165, and lower portion 162 has a lower curved wall 169 formed therein, which forms the lower portion of cavity 165. When upper and lower portions 160 and 162 are joined, curved walls 167 and 169 form cavity 165, which substantially spans the length of body 140. The longitudinal ends of cavity 165 are formed by walls 170 at each end of body 140. As shown in FIG. 13, body 140 may have one or more inlet ports 172 through which the liquid substance may be introduced to cavity 165. Each port 172 may be equipped with a hose barb (not shown) or other similar fitting so that hoses or piping may be connected to deliver the liquid substance to cavity 165 in a uniform and evenly distributed manner.

As best seen in FIG. 13, body 140 may include a linear slot 175 formed in the lower face or bottom wall of lower portion 162. Slot 175 is an opening formed in the lower curved wall 169 of cavity 165 that extends to the exterior of lower portion 162. In other words, cavity 165 is in flow communication with the exterior through slot 175. As explained further below, this allows the substance in cavity 165 to flow through slot 175 and onto the surface being treated. Slot 175 may be the same general length as cavity 165 or it may be shorter depending on the application. It is foreseen that there also may be more than one slot 175. The exact size and shape of slot 175 will be determined based on the specific application. For example, a large slot may result in a higher rate of flow for the substance coming from cavity 165. Considerations for the size and shape of slot 175 include size of area being treated, flow rate desired, pressure at which the substance is delivered to cavity 165, and viscosity of the substance being dispensed. In certain embodiments, the width of slot 175 may be in the range of one-eighth to one-quarter of an inch, although larger or smaller widths may also be appropriate.

As shown in FIG. 12, distribution apparatus 135 may include an elongate stopper 145 positioned within cavity 165. Stopper 145 comprises a horizontal member 180 taking the form of a rod or other similar elongated member. As best seen in FIGS. 15A and 15B, horizontal member 180 may have a square or rectangular transverse cross-sectional shape or any other suitable shape including circular or triangular. Stopper 145 further comprises a linear plug 185 extending downwardly from horizontal member 180. Linear plug 185 is sized and shaped to fit within slot 175 such that when plug 185 is received within slot 175, no substance will flow from cavity 165 through slot 175. Accordingly, the plug 185 will fit relatively snugly in slot 175 and extend sufficiently into slot 175 so that the slot is completely closed or plugged as shown in FIG. 15B. While the exact size and shape of plug 185 will depend on the size and shape of slot 175, in one embodiment plug 185 may be relatively long and narrow and extend downwardly from horizontal member 180 for approximately one quarter inch.

As best seen in FIG. 15A, slot 175 may include a chamfer or indentation 188 at the point that slot 175 intersects lower curved wall 169. The lower part of horizontal member 180 and/or the upper part of plug 185 may have a shape that approximates the shape of indentation 188. When plug 185 is received within slot 175, part of the plug 185 and/or horizontal member 180 may substantially align with indentation 188 and fill the space created by the indentation as shown in FIG. 15B. By aligning with indentation 188, stopper 145 can be more effective at stopping the flow of substance from cavity 165 through slot 175 because it is not relying solely on a tight fit between plug 185 and slot 175. In other words, the additional surface area created by indentation 188 increases the chance that stopper 145 is sufficiently pressed against a surface to prevent a substance from flowing to and through slot 175. Slot 175 may not include indentation 188, however in certain embodiments it may be effective to include the indentation 188 and then shape the stopper 145 to engage with indentation 188. The indentation 188 may have sidewalls that slope down toward slot 175, which presents a shape that is relatively easy to approximate on stopper 145, thus allowing the stopper 145 to fill indentation 188. In one embodiment, the sidewalls of indentation 188 are angled toward slot 175 at approximately thirty-five degrees with respect to horizontal.

As shown in FIGS. 13-15B, distribution apparatus 135 may also include a lifting plate 150 that raises and lowers stopper 145. Lifting plate 150 may be positioned above body 140 and be connected to stopper 145 using one or more lifting posts 192. The lifting posts 192 can take a number of forms including threaded rods or bolts. The upper end of lifting post 192 is secured to lifting plate 150 and the lower end of lifting post 192 is secured to stopper 145. Lifting post 192 may be secured to lifting plate 150 using a temporary fastening means such as a nut and washer or a more permanent means such as welding. Similarly, lifting post 192 may be secured to stopper 145 using a temporary means such as engaging the post with a threaded receiver on horizontal member 180 or a more permanent means such as welding the post 192 to horizontal member 180. Each lifting post 192 must pass through the upper portion 160 of body 140 to connect the stopper within the body 140 to the lifting plate 150 above the body 140. A seal assembly 195 may be used at each location where the post passes through the upper portion 160. Seal assembly 195 may be any number of seal assemblies known in the art including a gland or packing seal as well as a mechanical seal. Seal assembly 195 allows lifting post 192 to raise and lower while preventing the substance in cavity 165 from leaking through the sealed openings.

Figure 14A:
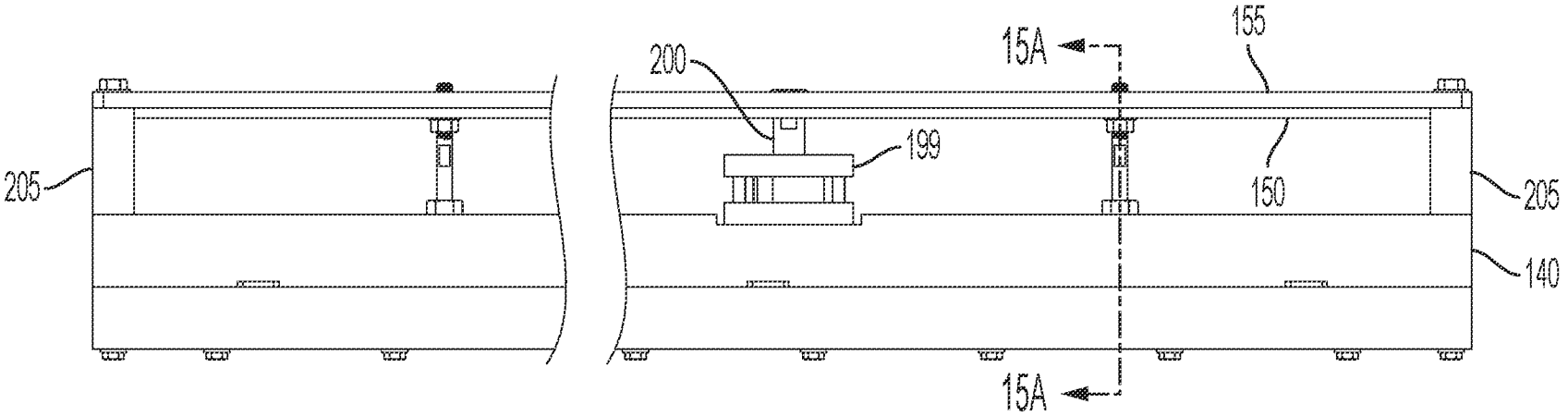
FIG. 14A is a partial side view of the distribution apparatus of FIG. 11 showing the lifting plate in a raised position.
Figure 14B:
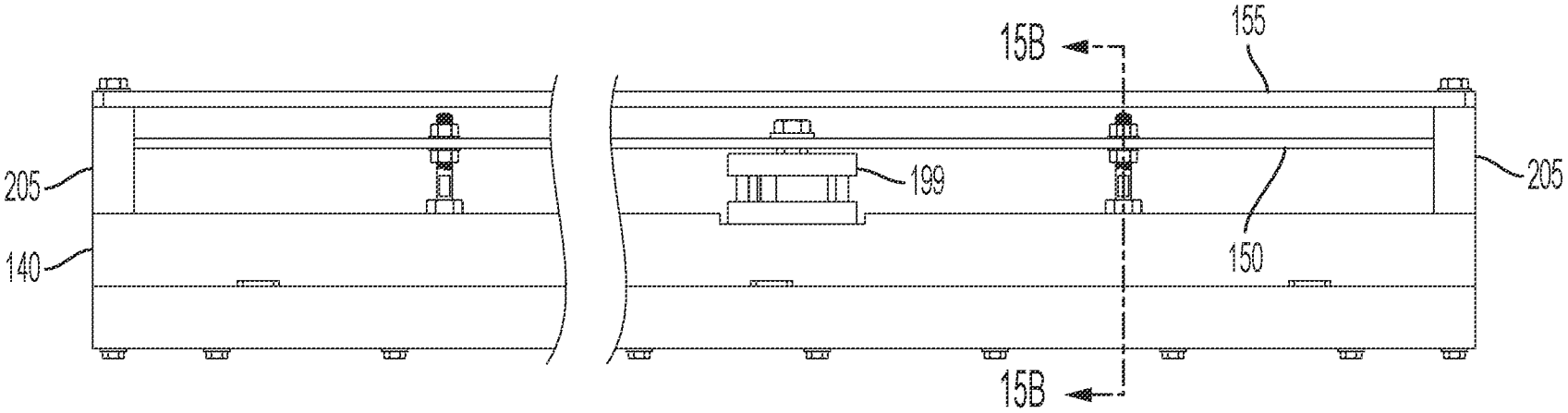
FIG. 14B is a partial side view of the distribution apparatus of FIG. 11 showing the lifting plate in a lowered position.

As best seen in FIGS. 11-13, lifting plate 150 may be raised and lowered by a pneumatic or hydraulically activated cylinder 199. One or more cylinders 199 may be attached atop body 140 between lifting plate 150 and body 140. The piston 200 of cylinder 199 may be attached to lifting plate 150. As best seen in FIG. 14A, when cylinder 199 is activated, piston 200 extends from or retracts toward cylinder 199 thereby moving lifting plate 150 either up or down. As lifting plate 150 moves, it also moves stopper 145 in cavity 165, thereby moving the stopper into or out of engagement with slot 175. Cylinder 199 may be any type of suitable cylinder known in the art including a single acting cylinder with spring or a double acting cylinder. The exact size of the cylinder will depend on the configuration of the distribution apparatus 135 and the substance being used for overlay 111. However, in one embodiment cylinder 199 may be a low-profile double-acting pneumatic cylinder having a two inch bore and three-quarter inch stroke.

Distribution apparatus 135 may also include an upper limit plate 155 located above lifting plate 150. Upper limit plate 155 serves as a stop for lifting plate 150, which in turn keeps stopper 145 from being lifted further than desired within cavity 165. Upper limit plate 155 is connected to body 140 using guides 205. Each guide 205 supports upper limit plate 155 above body 140 by a desired distance. Guides 205 may take a number of forms including cylindrical or cuboid. The bottom of each guide 205 may be attached to body 140 and the top of each guide 205 may be attached to upper limit plate 155. The size and shape of upper limit plate 155 may approximate the size and shape of body 140, however is foreseen that other sizes and shapes may work as well.

Each guide 205 may be located at a corner of upper limit plate 155 and a corresponding corner of body 140. The space between the pair of guides 205 at each end of the upper limit plate 155 forms a guideway 209. Accordingly, when guides 205 are placed at each corner of upper limit plate 155 and the corresponding corners of body 140, there are two guideways 209 formed (one at each end). Lifting plate 150 may include tabs 211 that fit within the guideways 209. As lifting plate 150 moves up and down, the tabs 211 travel within their respective guideways 209, which keeps lifting plate 150 traveling in a generally vertical path. Since lifting plate 150 travels a generally vertical path, stopper 145 is moves generally vertical and maintains a generally vertical orientation within cavity 165. Because stopper 145 maintains a generally vertical orientation, the likelihood of plug 185 becoming received in slot 175 is increased. If stopper 145 were to move from a vertical orientation, it could be difficult to seat plug 185 in slot 175 given the relatively narrow dimension of the slot and the relatively tight tolerances of the dimensions of plug 185 and slot 175. When lifting plate 150 moves upward to the point of contacting upper limit plate 155, lifting plate 150 is pressed against upper limit plate 155 thereby stopping upward movement of the lifting plate. Lifting plate 150 stays pressed against upper limit plate 155 until it is retracted by a cylinder 199 or some other force.

The invention also includes a method of creating and applying a polymer-based overlay 111 to a surface (e.g., new or worn roadways, sidewalks, parking lots, bridges) for purposes of repair, enhancing physical properties or reinforcement. The method, which may or may not utilize mixing system 10 and/or distribution apparatus 135, may comprise the following steps:

As an initial step, a resin 60*a* and a hardener 60*b* may be held in separate containers such as a first holding tank and a second holding tank. There are various types of resins and hardeners and the exact type will depend on the properties desired for the overlay 111. Different resins and hardeners will create different overlays with different properties. For example, certain overlays may perform better in certain weather conditions than other overlays. Ultimately, the resin and hardener are selected based on what creates the best performing overlay for the specific application.

Next, resin 60*a* and hardener 60*b* may be pumped (using pumps like first pump 25*a* and second pump 25*b*) from the holding containers to and through a manifold (such as manifold 35) where substances can flow together. The pumps may be controlled by an automated control system. Flow meters and pressure gauges may be placed in piping or tubing between the pumps and the manifold. Resin 60*a* and hardener 60*b* may travel through separate channels in the manifold to a confluence area at which point they can flow together to form a mixture 91 that exits through an outlet in the manifold. Once the resin 60*a* and hardener 60*b* contact each other, the mixture 91 starts to cure, and curing is enhanced by further blending the mixture 91.

Next, the mixture 91 leaves the manifold and may enter a mixer (such as mixing chamber 40). The mixer may be a static mixer that includes a cylindrical sleeve that houses one or more mixing elements having interwoven vanes or baffles that are fixed with respect to one another and the sleeve. The baffles blend and mix the mixture 91 as it passes through the mixing elements by forcing portions of the mixture 91 to intermix due to being displaced by the baffles. It is foreseen that the mixer in this step may alternatively include movable fans or paddles. Mixture 91 may be sufficiently mixed and the curing reaction between resin 60*a* and hardener 60*b* is enhanced once mixture 91 exits the mixer in a mixed state.

At this point, the mixture 91 may enter a second manifold or similar chamber having one or more outlets. The mixture 91 may exit the outlets through hoses or piping and be directed to a distribution apparatus 135. The mixture 91 may enter the apparatus through one or more inlet ports 172 and then move into cavity 165. If more than one inlet port 172 is used, the hoses or piping connected to the ports 172 may be the same length so that the static pressure in the hoses or piping is equal and the system is somewhat self-balancing. In that scenario, approximately the same amount of mixture 91 would be delivered through each inlet port 172. Once the cavity 165 is substantially full, the pressure in the system will move mixture 91 to and through linear slot 175 if stopper 145 has been retracted from the slot. At this point the mixture 91 is distributed to the surface being treated. If the mixture 91 should not yet be applied to the surface, stopper 145 can be in a lowered position thereby closing or plugging slot 175. The stopper 145 is raised and lowered through operation of cylinder 199, which may be manually operated or automatically controlled by a control system. One benefit of using the distribution apparatus 135 is that it allows for a definitive on or off state due to its slot 175 and stopper 145 configuration. In other words, mixture 91 will either flow or not flow from the apparatus, rather than having a partial flow from the system which may be undesirable. The distribution apparatus 135 can handle relatively high flow rates (e.g., up to 15 gallons per minute). The slot also allows for uniform thickness or width of the mixture being dispensed.

Next, an aggregate 108 may be added to mixture 91. This step may occur either before or after mixture 91 is applied to a surface. Aggregate 108 may include granular materials, such as sand or stone, which help add volume, strength, and durability to the overlay 111. An aggregate that helps improve vehicle and pedestrian traction when traveling over overlay 111 may also be added to mixture 91 or applied to the surface of overlay 111. Aggregate may be blended into mixture 91 using a mixing device with an agitator (such as mix bowl 50).

Next, the blended combination of aggregate 108 and mixture 91 may be applied to the desired surface and allowed to cure to form overlay 111. When the substance is applied to the surface, it may be leveled or troweled to create an overlay 111 that is a desired shape, thickness and texture. The substance and overlay may also undergo other surface treatments such as aggregate coating, painting, sealing, or texturing as desired.

Any or all of the components in the above mentioned method may be mounted to a motor vehicle.

It is to be understood that while certain forms of the present invention have been illustrated and described herein, it is not to be limited to the specific forms or arrangement of parts described and shown.

Having thus described the invention, what is claimed as new and desired to be secured by Letters Patent is:

1. An apparatus for dispensing a mixture to create an overlay to reinforce or repair a surface, said apparatus comprising:

a shell having an upper portion and a lower portion, wherein a cavity is formed within said shell, said upper portion being separable from said lower portion;

a linear dispensing slot formed in said lower portion of said shell, said slot extending through said lower portion to the exterior of said shell and being in fluid communication with said cavity, thereby providing an outlet for dispensing the mixture;

a stopper assembly positioned within said cavity, said stopper assembly comprising a horizontal member and a linear plug extending downwardly from said horizontal member, said liner plug sized and shaped to fit within said dispensing slot;

wherein said stopper assembly is selectively positionable in a raised position in which said linear plug is withdrawn from said slot to allow dispensing of the mixture, or in a lowered position, in which said linear plug engers and seals said slot to prevent flow of the mixture; and a lifting post attached to said stopper, said lifting post adapted to move said stopper into said raised position or said lowered position.

2. The apparatus of claim 1 further comprising a lifting plate secured to said lifting post, wherein said lifting post moves said stopper when said lifting plate moves said lifting post, and wherein said lifting plate is moved by at least one pneumatic cylinder controlled by a control system.

3. The apparatus of claim 2 further comprising a limit plate located over said lifting plate that limits upward movement of said lifting plate.

4. The apparatus of claim 1 wherein said slot is formed in a bottom wall of said lower portion of said shell.

5. The apparatus of claim 4, further comprising a notch where said upper and lower portions of said shell are mated, wherein said notch is adapted to receive a tool to help separate said upper and lower portions.

* * * * *